US008997729B1

(12) United States Patent
Gillig

(10) Patent No.: US 8,997,729 B1
(45) Date of Patent: Apr. 7, 2015

(54) ARCHERY BOWSTRING RELEASE

(71) Applicant: Tru-Fire Corporation, Madison, WI (US)

(72) Inventor: Jason Gillig, Neenah, WI (US)

( * ) Notice: Subject to any disclaimer, the term of this patent is extended or adjusted under 35 U.S.C. 154(b) by 0 days.

(21) Appl. No.: 13/714,480

(22) Filed: Dec. 14, 2012

Related U.S. Application Data

(60) Provisional application No. 61/570,928, filed on Dec. 15, 2011.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS

| | | | | | |
|---|---|---|---|---|---|
| 4,009,703 | A * | 3/1977 | Cunningham, Sr. | ..... | 124/35.2 |
| 4,232,649 | A * | 11/1980 | Allen et al. | ..... | 124/35.2 |
| 4,316,443 | A * | 2/1982 | Giacomo | ..... | 124/35.2 |
| 4,791,908 | A * | 12/1988 | Pellis | ..... | 124/35.2 |
| 5,370,102 | A * | 12/1994 | Peck | ..... | 124/35.2 |
| 6,484,710 | B1 * | 11/2002 | Summers et al. | ..... | 124/35.2 |
| 7,240,672 | B2 * | 7/2007 | Peck et al. | ..... | 124/35.2 |

* cited by examiner

*Primary Examiner* — John Ricci
(74) *Attorney, Agent, or Firm* — Craig A. Fieschko, Esq.; DeWitt Ross & Stevens S.C.

(57) ABSTRACT

An archery bowstring release has a single jaw for retaining a bowstring within a bowstring hook, in contrast to dual-jaw pincer-type releases. The bowstring hook is situated on a release head which bears a trigger for actuating the jaw and releasing the bowstring, and a release body extends between the release head and a release mount (which can connect the bowstring release to a wrist strap, glove, or other anchor affixed to the user's body). The release head and body are pivotally joined, and when the release is ready to fire, the central axis of the release body, and at least the rear of the release head, have central longitudinal axes which are aligned with the notch in the bowstring hook, and are thus aligned with the bowstring, and are parallel to or in line with the arrow. The release therefore has a comfortable, natural, and intuitive feel during operation.

25 Claims, 3 Drawing Sheets

100
102
102A
104
106
108
110
112
114
116
118
120
122
124
126
128
130
132
134
136
138
140
142
144
146
148
150
152
154
156
158
160
162
164
166
168
170
172
174
176
178
180
182
184
186
188
190
1028

ARCHERY BOWSTRING RELEASE

CROSS-REFERENCE TO RELATED APPLICATIONS

This application claims priority under 35 USC §119(e) to U.S. Provisional Patent Application 61/570,928 filed Dec. 15, 2011, the entirety of which is incorporated by reference herein.

FIELD OF THE INVENTION

This document concerns an invention relating to archery bowstring releases.

BACKGROUND OF THE INVENTION

Archery bowstring releases are devices commonly used by archers to grasp a bowstring and then release it after the bowstring has been pulled. A bowstring release can help increase the accuracy of the archer's shot by providing more controlled and consistent release of a bowstring. Because the archer does not need to use his/her fingers to hold the bowstring, the release can enhance the archer's comfort. Releases are often provided in the form of handheld or hand-mounted jaws which grip the bowstring, and which can be actuated by the archer via a trigger. Examples of prior bowstring releases can be found in U.S. Pat. Nos. 5,564,407 and 5,582,158 to Linsmeyer, U.S. Pat. Nos. 6,763,819 and 7,753,043 to Eckert, and U.S. Pat. No. 7,240,672 to Peck et al., the contents of which should be regarded as part of this document as if they were appended thereon.

SUMMARY OF THE INVENTION

The invention involves a bowstring release which is intended to provide a relatively simple (yet elegant) alternative to prior bowstring releases. To give the reader a basic understanding of some of the advantageous features of the invention, following is a brief summary of exemplary versions of the bowstring release, with reference being made to the accompanying drawings (which are briefly reviewed in the following "Brief Description of the Drawings" section of this document) to assist the reader's understanding. Since the following discussion is merely a summary, it should be understood that more details regarding the exemplary versions may be found in the Detailed Description set forth elsewhere in this document. The claims set forth at the end of this document then define the various versions of the invention in which exclusive rights are secured.

The accompanying FIG. 1 depicts an exemplary preferred bowstring release 100 having a release head 102 with a bowstring hook 104 actuated by a trigger 106, and an elongated release body 108 extending between a forward body end 110 to which the head 102 is affixed (preferably rotatably affixed, as discussed below) and a release mount 112. The release mount 112 allows easy attachment of the bowstring release 100 to a wrist band/strap, glove, or other arm mounting means for anchoring the bowstring release 100 to a user's hand, wrist, or arm (to which the bowstring release 100 will generally be pivotally mounted owing to a flexible fixture between the arm mounting means and the release mount 112, for example, by flexible straps affixed about the release mount 112). The bowstring release 100 may therefore be anchored to a user's hand, wrist, or arm; the user may situate a bowstring in a bowstring notch 114 in the hook 104; and the user may then pull his/her hand, wrist, or arm (and thus the bowstring release 100) rearwardly to draw the bow. The user may then pull the trigger 106 to move the hook 104 between the positions shown in FIGS. 3-4, thereby "unhooking" and releasing the bowstring (and thus releasing an arrow).

The release 100 is preferably configured so that the head 102 and body 108, or at least the head 102, will align with the direction of the bowstring's pull—and thus with the length of the arrow—during use of the release 100. To explain in greater detail, the head 102 extends between a forward head end 116 bearing the hook 104 and an opposing rear head end 118 affixed to the forward body end 110, wherein the rear head end 118 can be regarded as having a rear head longitudinal central axis extending forwardly therefrom, and the forward head end 116 can be regarded as having a forward head longitudinal central axis extending rearwardly therefrom. The head 102 has a bend 120 between the rear head end 118 and the forward head end 116, whereby the forward head longitudinal central axis and rear head longitudinal central axis are displaced from each other at the forward head end 116, preferably with the forward head longitudinal central axis and rear head longitudinal central axis being at least substantially parallel to each other. The bowstring notch 114 of the hook 104 is then situated at least substantially coincident with the rear head longitudinal central axis (when the hook 104 is in the bowstring retaining position of FIG. 3), in other words, the bowstring notch 114 (and thus any bowstring therein) is "in line" with the axis of the rear head end 118. Similarly, the body 108 has a body longitudinal central axis which is preferably oriented at least substantially coincident with the rear head longitudinal central axis (and thus with the bowstring notch 114 when the hook 104 is in the bowstring retaining position of FIG. 3), and is also oriented at least substantially parallel to the forward head longitudinal central axis. As a result, when a user pulls back the release 100, and thereby pulls back any bowstring hooked therein, the axis of the body 108, and the axes of the head 102, will extend along (or parallel to) the line of pull force, and thus with the length of the arrow. This provides a more comfortable and natural feel to the user, and can deter irregularities with the smoothness and timing of bowstring release 100, since the bowstring will always be fully received within the bottom of the bowstring notch 114 (rather than, for example, riding against one of its sides). To further assist this advantage, the rear head end 118 may be pivotally affixed to the forward body end 110 at a juncture pivot 122, as exemplified in FIGS. 3A and 3B (showing the head 102 tilting approximately 15 degrees in opposing directions—typically rightwardly and leftwardly, when in use—with respect to the body 108 as shown in FIG. 3). With this arrangement, even if a user has imperfect technique—for example, if the user grips the body 108 and urges it in some direction oblique to the axis of the arrow, perhaps in an attempt to adjust the aim of the arrow—the head 102 will pivot such that its axes will extend along (or parallel to) the axis of pull force (which corresponds to the arrow's axis). So that the head 102 is not "floppy" with respect to the body 108, the pivoting of the head 102 is preferably limited to perhaps 15 degrees about the body longitudinal central axis, which is typically sufficient to accommodate any skewing force that a user's hand might apply to the body 108.

FIGS. 3-4 illustrate an exemplary preferred mechanism for actuation of the hook 104 via the trigger 106. The hook 104 is situated on a jaw 124, and has a hook length curving about the bowstring notch 114, with opposing hook sides defined by an inner jaw surface 126 (the surface extending about the bowstring notch 114) and an opposing outer jaw surface 128 (the surface defining at least a portion of the radially outermost surface of the hook 104). A latching surface 130 is situated on the jaw 124 opposite the bowstring hook 104, and between the inner jaw surface 126 and outer jaw surface 128, and is depicted with a curved outer latching surface section 132 adjacent the outer jaw surface 128, an opposing inner latching surface section 134 adjacent the inner jaw surface 126, and a jaw latch 136 therebetween, wherein the jaw latch 136 interacts with the trigger 106 as discussed below. The latching surface 130, inner jaw surface 126, and outer jaw surface 128 define an approximately triangular jaw body 138 opposite the hook 104. A jaw pivot 140 is situated approximately between the jaw body 138 and the hook 104, near the apex of the jaw body 138 where the inner jaw surface 126 and outer jaw surface 128 approach each other opposite the latching surface 130, to rotatably affix the jaw 124 to the forward head end 116.

The trigger 106 is then defined as a portion of a trigger member 142 extending between the trigger 106 and an inner trigger member surface 144, and which is rotatably affixed to the head 102 at a trigger pivot 146. A trigger front face 148 is situated between the trigger 106 and inner trigger member surface 144, and it bears a trigger catch 150 which engages the jaw latch 136 when the trigger 106 is in a forward position (FIG. 3) to fix the jaw 124 into the bowstring retaining position, wherein the hook 104 curves rearwardly. When the trigger 106 is in a pulled position (FIG. 4), the trigger catch 150 disengages the jaw latch 136 to allow the jaw 124 to pivot, under the force of the pulled bowstring in the hook 104, into a bowstring releasing position wherein the hook 104 no longer curves rearwardly, and the bowstring is released. A curved trigger front surface 152 is situated next to the catch 150 on the trigger front face 148, wherein the curved trigger front surface 152 travels closely adjacent the outer latching surface section 132 of the jaw 124 as the jaw 124 rotates from the bowstring retaining position to the bowstring releasing position. A trigger spring 154 bears against a rear trigger surface 156 opposite the trigger front face 148 to urge the trigger 106 toward the forward position, and thereby have the trigger catch 150 engage the jaw latch 136 (as in FIG. 3). The trigger spring 154 and trigger catch 150 are preferably aligned along an axis oriented at least substantially parallel to the rear head longitudinal central axis.

The bowstring release 100 has only a single jaw 124 and bowstring hook 104, in contrast to "pincer" or "caliper"-type bowstring releases having dual-jaw and similar arrangements wherein a bowstring is retained by two or more jaws/hooks. Owing to the single exposed hook 104, it is particularly easy for a user to catch a bowstring with the hook 104 (when the jaw 124 is in the bowstring retaining position of FIGS. 1 and 3, with the hook 104 curving rearwardly), and pull the release 100 back to thereby pull back the bowstring. Owing to the aforementioned alignment of the axes of the rear head end 118 and the body 108 closely parallel or coincident with the axis of the arrow, the release 100 provides a particularly comfortable and intuitive feel to a user when pulling back and releasing a bowstring.

The bowstring release 100 preferably incorporates a trigger force adjustment mechanism, with a preferred example being shown in FIG. 5. A cup 192 is situated about the end of the trigger spring 154 opposite the spring end that bears against the trigger member 142. At a location near the bend 120 in the head 102, an adjustable member 194 (here a screw) then extends through the head 102 to bear against the cup 192. Adjustment of the adjustable member 194 into or out of the head 102 will therefore adjust the force of the trigger spring 154 exerted on the trigger member 142, making it easier or harder for a user to pull the trigger 106 to have the trigger catch 150 disengage the jaw latch 136 and thereby allow the jaw 124 to move to the bowstring releasing position.

Further advantages, features, and objects of the invention will be apparent from the remainder of this document in conjunction with the associated drawings.

DETAILED DESCRIPTION OF PREFERRED VERSIONS OF THE INVENTION

Figure 3A:
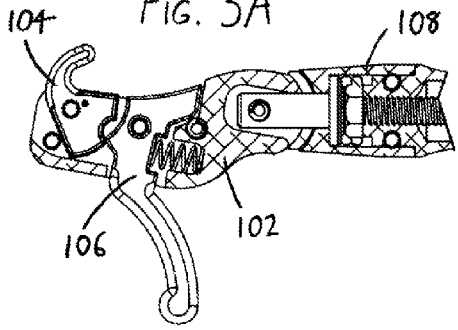
FIGS. 3A and 3B respectively show the release head 102 of FIG. 3 pivoted to opposing sides.
Figure 3B:
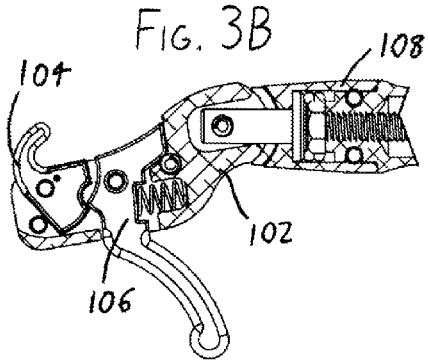
Figure 3:
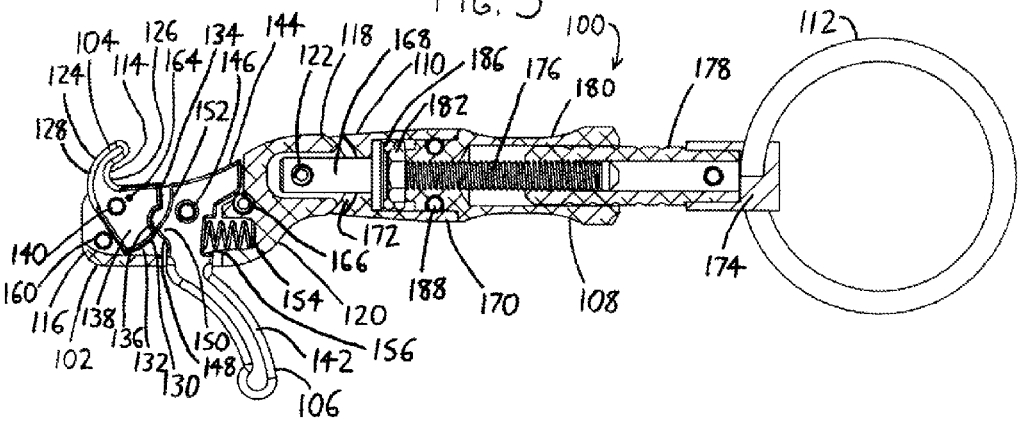
FIG. 3 is a side cross-sectional view of the bowstring release 100 of FIG. 1, showing the trigger 106 in the forward position and the jaw 124 in the bowstring retaining position (as in FIG. 1).
Figure 4:
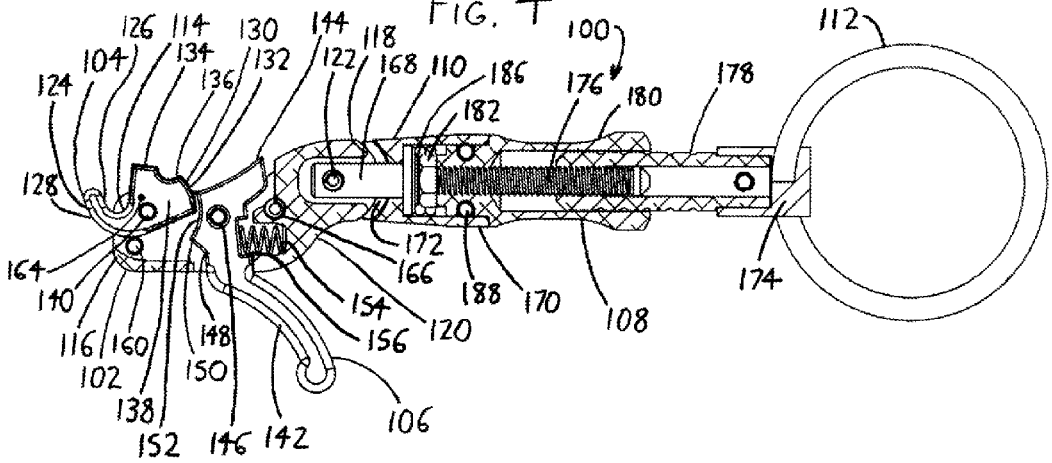
FIG. 4 is a side cross-sectional view of the bowstring release 100 corresponding to FIG. 3, but showing the trigger 106 in the pulled position and the jaw 124 in the bowstring releasing position.
Figure 5:
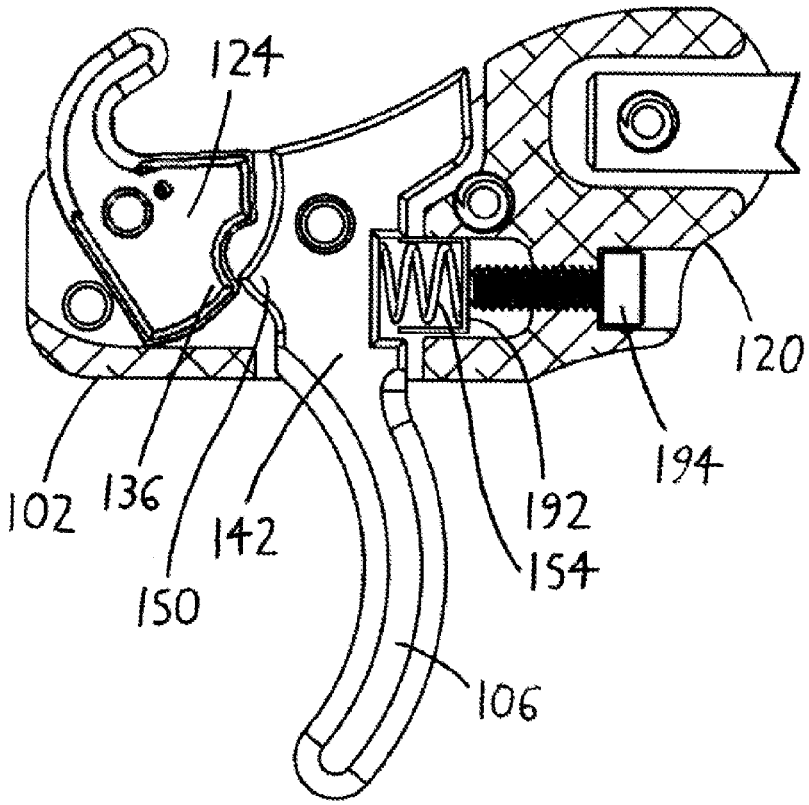
FIG. 5 is a side cross-sectional view of the head 102 of the bowstring release 100 of FIGS. 1-4, shown with the addition of a trigger force adjustment mechanism wherein adjustment of the adjustable member (screw) 194 increases or decreases resistance to pulling the trigger 106.

To briefly review the operation of the exemplary version of the bowstring release 100 shown in the Figures in greater detail, when a bowstring is retained within the open bowstring notch 114 (when the jaw 124 is in the bowstring retaining position of FIGS. 1 and 3, with the hook 104 curving rearwardly), pulling the trigger 106 moves the trigger catch 150 from the jaw latch 136, and the jaw 124 then pivots under the force of the bowstring to move the jaw 124 into the bowstring releasing position of FIG. 4. Comparing FIGS. 3 and 4, note that the curved trigger front surface 152 is configured to rotate past the outer latching surface section 132 of the jaw 124 as the jaw 124 moves to the bowstring releasing position. To "reload" the bowstring release 100, the use may manually rotate the jaw 124 from the position shown in FIG. 4 back to the bowstring retaining position of FIG. 3, with the outer latching surface section 132 of the jaw 124 acting as a cam which urges against the curved trigger front surface 152 to push the trigger 106 rearwardly against the force of the trigger spring 154. More preferably, the jaw 124 is spring-loaded to automatically rotate back to the bowstring retaining position of FIG. 3 once the bowstring is released. In the exemplary bowstring release 100 shown in the drawings, this is done via a jaw (torsion) spring 158 (FIG. 2) which is fit about the jaw pivot 140 between (and engaging both of) the jaw 124 and the head 102. The jaw spring 158 does not have sufficient strength to resist the rotation of the jaw 124 from the bowstring retaining position (FIG. 3) to the bowstring releasing position (FIG. 4) under the force of a bowstring, but it does have sufficient strength to rotate from the position shown in FIG. 4 to that of FIG. 3 when the force of the bowstring is removed, urging the trigger 106 rearwardly against the force of the trigger spring 154 until the jaw 124 returns to the bowstring retaining position (FIG. 3).

Assembly of the bowstring release 100 will now be discussed with reference to FIG. 2, which shows the bowstring release 100 in disassembled/exploded form. Initially, the trigger pivot 146, the jaw pivot 140, and a jaw stop 160 (if used) are inserted into corresponding apertures in the head section 102A. The jaw spring 158 is fit over the installed jaw pivot 140, and slid therealong into a spring pocket 162 formed in the body 108 (where an end of the jaw spring 158 engages with a small groove in the spring pocket—the jaw spring end and groove not being visible in the drawings—to rotationally restrain the jaw spring end). The jaw 124 is then installed over the jaw pivot 140 with the opposing end of the (preloaded) jaw spring 158 being fit within a jaw spring receiver 164 in the jaw 124, thereby spring-loading the jaw 124 towards the retaining position of FIGS. 1 and 3. The trigger 106 is then installed over the trigger pivot 146 on the head section 102A with the trigger spring 154 situated between the head section 102A and the rear trigger surface 156. The opposing head section 102B is then fit to the head section 102A, and the head sections 102A and 102B are secured together via fasteners 166 to effectively complete assembly of the head 102.

A pivot member 168 is then inserted into the rear end of a body cap 170 to extend forwardly therethrough. A washer 172, which is preferably made of an elastomeric substance such as neoprene, is fit over the protruding end of the pivot member 168 to rest adjacent the body cap 170. The protruding end of the pivot member 168 is then inserted into the rear head end 118 of the head 102 such that the rounded rear head end 118 fits within a concave depression at the forward end of the body cap 170, and the rear head end 118 and the protruding end of the pivot member 168 are pivotally affixed together via the juncture pivot 122. The washer 172 is compressed after such attachment, such that it resists rotation of the head 102 with respect to the body 108, but not so much resistance that the head 102 resists pivoting when subjected to the pull of a bowstring. The washer 172 need not have the annular shape of a conventional washer, and rather can assume any form which rests between and bears against the rear head end 118 and the forward body end 110 (here the forward end of the body cap 170) without interfering with the intervening pivotable connection between the head 102 and the body 108.

Preferably, the body 108 is then assembled. The ends of the wire ring of the release mount 112 are snapped into a release mount base 174. Referring also to FIGS. 3-4, one end of a threaded adjustment rod 176 is threaded into an internally threaded body adjustment sleeve 178, and its opposing end (and the body adjustment sleeve 178) are inserted into a body length adapter 180, with the opposing end of the adjustment rod 176 further being threaded into the body length adapter 180 until it extends from the opposite end of the body length adapter 180. A nut 182 then further secures this end of the adjustment rod 176 to the body length adapter 180. The adjustment sleeve 178 is inserted into the release mount base 174 and affixed therein via a pin 184. O-rings 186 are inserted into the body cap 170, followed by the body length adapter 180. Pins 188 are then inserted into the body cap 170 to secure the body length adapter 180 therein. The length of the body 108 can then be adjusted by rotating the body adjustment sleeve 178 with respect to the body cap 170, and about the adjustment rod 176 therein. If desired, a set screw 190 extending through the body length adapter 180 can be provided to bear against the adjustment sleeve 178, and can be loosened/tightened to unfix or fix the adjustment sleeve within the body length adapter 180.

While this document does not detail examples of wrist bands/straps, gloves, or other arm mounting means suitable for use with the bowstring release 100, examples can be found in, for example, U.S. Pat. Nos. 7,320,318 and 7,422,008, and in the patents referenced therein. The bowstring release 100 is not limited to use with these arm mounting means, and others may be used instead, and the form of the release mount 112 may be varied as desired to achieve the desired attachment to the desired arm mounting means. Here, the release mount 112 is shown as a "snap-back" release mount 112 of the type described in U.S. Pat. No. 7,753,043. As an alternative, the release mount 112 could alternatively take the form of a handle which could be grasped by some of the user's fingers, with the user's trigger finger then reaching from the handle to the trigger 106.

Throughout this document, when it is said that axes are at least substantially coincident (e.g., the body longitudinal central axis, the rear head longitudinal central axis, and the axis of the bowstring notch 114), this can be understood to mean that oblique intersecting axes are offset by no more than about 5 degrees; that parallel axes are displaced by no more than about 5% of the diameter of the thickest component through which one of the lengthwise axes extends; and that oblique non-intersecting axes follow both of these conditions at the location at which the axes are most closely spaced.

Preferred versions of the invention have been described above in order to illustrate how to make and use the invention. The invention is not intended to be limited to these versions, but rather is intended to be limited only by the claims set out below, with the invention encompassing all different versions that fall literally or equivalently within the scope of these claims. Thus, it should be understood that the invention can be provided in forms having appearances and features different from the exemplary versions described above. A few examples of proposed modifications follow.

It is initially emphasized that bowstring releases need not include all of the features described above, for example, a bowstring release need not have all of a single jaw, a body axis aligned with the bowstring, a head pivotable with respect to the body, and trigger force adjustment. For example, the bowstring release 100 of FIGS. 1-5 need not incorporate one or more of the body-bowstring axial alignment, pivotable head, and trigger force adjustment features; or one or more of the pivotable head and trigger force adjustment features might be incorporated into a bowstring release lacking the single-jaw and body-bowstring axial alignment features (for example, into a dual-jaw bowstring release such as one shown in the prior patents noted earlier in this document); etc.

Other types of trigger force adjustment can be incorporated instead of, or in addition to, the type discussed previously. As a first example, it has been found useful to situate a second spring—preferably an elastomeric spring, such as a rubber rod—within the trigger spring 154 (FIG. 5) to adjust the effective stiffness of the spring 154, and effectively magnify the impact of adjustments to the adjustable member 194. It should therefore be understood that the spring 154 can be provided by single or multiple springs, and that such springs need not be helical springs. In similar respects, the adjustable member 194 need not be a screw, and could be any member configured to be adjustably fit to desired depths within the body (such as a force-fit pin, a lever-actuated push rod, or other appropriate structure). As another example, in FIG. 3, a set screw (or other adjustable member) could extend through the inner trigger member surface 144 to bear against the body 108 at a location adjacent the fastener 166, whereby the greater the degree to which the set screw is inserted/extended, the less the amount the trigger 106 needs to be pulled to release the jaw 124 from the bowstring retaining position to the bowstring releasing position. The trigger force adjustment mechanism can be incorporated into bowstring releases wherein the trigger actuates bowstring release mechanisms other than single-jaw release mechanisms, for example, dual-jaw release mechanisms, release mechanisms wherein a cord or the like restrains and then releases the bowstring, etc.

The body 108 of the bowstring release 100 is not required, and a more compact version of the bowstring release 100 might simply situate the release mount 112 at the rear head end 118 (for example, by joining the release mount base 174 to the head 102 of the pivot member 168). As another alternative, the release body 108 need not be pivotally joined to the release head 102, and might be rigidly affixed thereto, such that it effectively defines the rear head end 118.

Figures 1, 2:
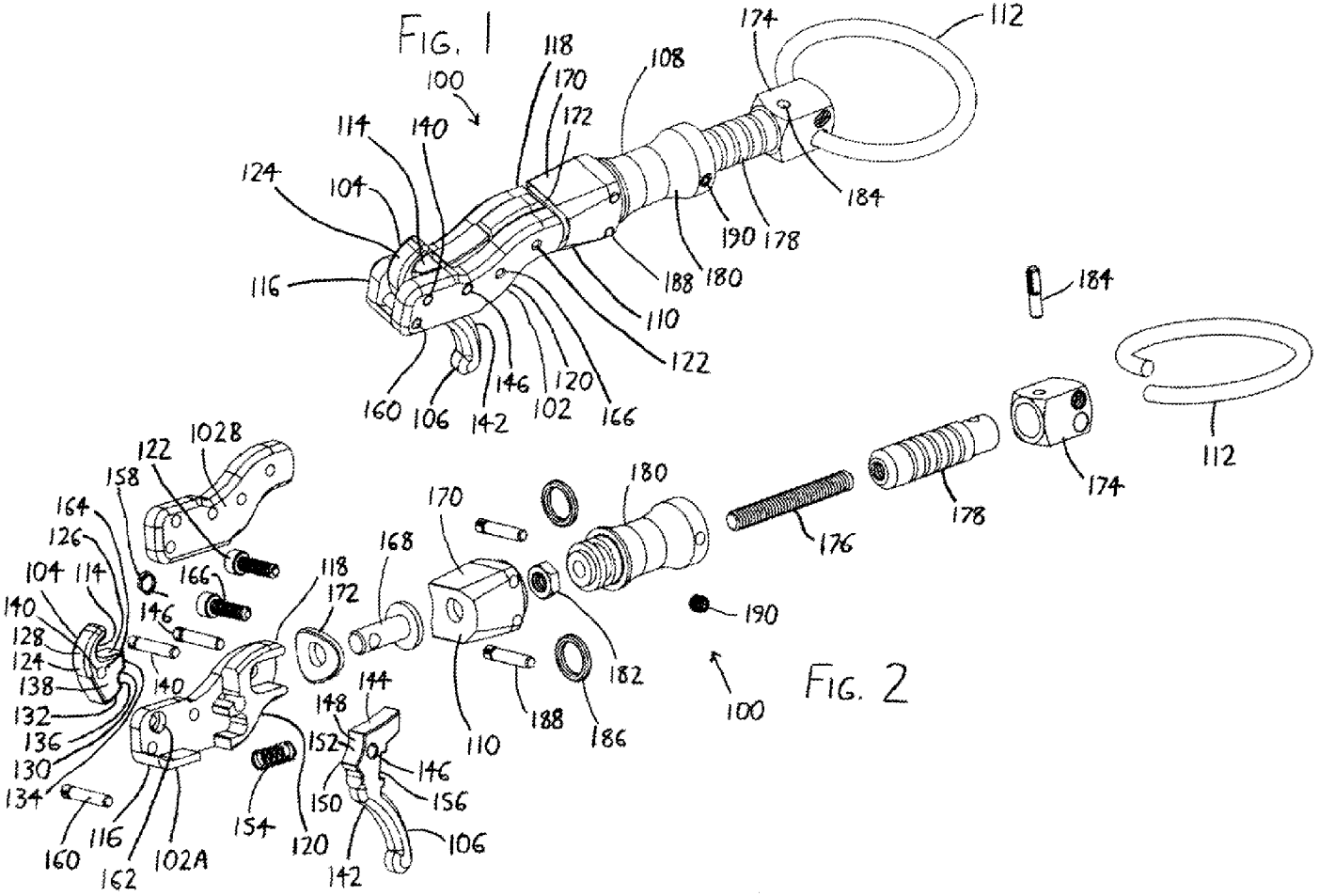
FIG. 1 is a perspective view of an exemplary bowstring release 100 which illustrates principles of the invention, with the release 100 having a release head 102 with a bowstring hook 104 and hook-actuating trigger 106, and a release body 108 extending from the head 102 to a release mount 112.
FIG. 2 is an "exploded" (disassembled) perspective view of the bowstring release 100 of FIG. 1.

In the exemplary bowstring release 100, as best seen in FIGS. 2-4, the jaw latch 136 is shown as a corner of a detent formed in the latching surface 130 approximately midway between the inner jaw surface 126 and outer jaw surface 128. The trigger catch 150 is then shown as a protrusion extending from the trigger front face 148. However, other arrangements are possible, as by defining the trigger catch 150 as a detent and the jaw latch 136 as a protrusion, or by simply defining both of the trigger catch 150 and jaw latch 136 as opposing step-like lands, or any other suitable arrangement allowing the trigger 106 to engage the jaw 124 when in the forward position, and disengage the jaw 124 when in the pulled position.

Finally, bowstring releases in accordance with the invention can also incorporate features known from prior releases, for example, features of the releases of the patents noted earlier in this document, or still other features.

What is claimed is:

1. A bowstring release including:

a. a head extending between a forward head end and an opposing rear head end, wherein the head includes:

(1) a rear head longitudinal central axis extending forwardly from the rear head end, (2) a forward head longitudinal central axis extending rearwardly from the forward head end, (3) a bend between the rear head end and the forward head end, whereby the forward head longitudinal central axis and rear head longitudinal central axis are displaced from each other at the forward head end, and (4) a bowstring release mechanism having:

(1) a trigger, and (2) a bowstring hook with a bowstring notch defined therein;

b. an elongated body:

(1) extending between a forward body end and a release mount, wherein the forward body end is pivotally affixed to the rear head end, and (2) having a body longitudinal central axis which is at least substantially coincident with the bowstring notch.

2. The bowstring release of claim 1 wherein the head further includes a spring:

a. having an end bearing against a trigger member bearing the trigger, and b. being situated between the trigger member and an adjustable member adjustably fit within the body, wherein the adjustable member's depth within the body can be adjustably reset;

wherein adjusting the adjustable member into the body compresses the spring between the adjustable member and the trigger member.

3. The bowstring release of claim 1 wherein the rear head longitudinal central axis is also at least substantially coincident with the bowstring notch.

4. A bowstring release including:

a. a head extending between a forward head end and an opposing rear head end, wherein:

(1) the head includes a bowstring release mechanism having a trigger, and (2) the rear head end is rounded;

b. an elongated body extending between a forward body end and a release mount, wherein:

(1) the forward body end is pivotally affixed to the rear head end, and (2) the forward body end bears a concave depression wherein the rear head end is fit.

5. The bowstring release of claim 4 wherein a pivot member:

a. protrudes forwardly from the forward body end into the head, and b. is rotatably pinned to the head therein, whereby the head pivots about the pivot member.

6. The bowstring release of claim 4 wherein a compressible washer is situated in compression between the rear head end and the forward body end.

7. A bowstring release including:

a. a head extending between a forward head end and an opposing rear head end, wherein the head includes a bowstring release mechanism having a trigger;

b. an elongated body extending between a forward body end and a release mount, wherein the forward body end is pivotally affixed to the rear head end, wherein a compressible washer is situated in compression between the rear head end and the forward body end.

8. A bowstring release including:

a. a head extending between a forward head end and an opposing rear head end, wherein the head includes:

(1) a single jaw:

i. having a bowstring hook extending therefrom, the bowstring hook having a hook length curving about a bowstring notch;

ii. having a latching surface opposite the bowstring hook, the latching surface having a jaw latch defined thereon;

iii. wherein the jaw is rotatably affixed to the head at a jaw pivot, whereby the jaw is rotatable between:

A. a bowstring retaining position wherein the hook curves rearwardly, and

B. a bowstring releasing position wherein the hook no longer curves rearwardly;

(1) a bowstring release mechanism having a trigger, the trigger being situated on a trigger member:

i. rotatably affixed to the head about a trigger pivot;

ii. having a trigger catch thereon, iii. being rotatable between:

i. A. a forward position wherein the trigger catch engages the jaw latch to fix the jaw into the bowstring retaining position, and ii. B. a pulled position wherein the trigger catch disengages the jaw latch to allow pivoting of the jaw into the bowstring releasing position;

b. an elongated body extending between a forward body end and a release mount, wherein the forward body end is pivotally affixed to the rear head end.

9. The bowstring release of claim 8 wherein:

a. the head further has:

(1) a rear head longitudinal central axis extending forwardly from the rear head end, (2) a forward head longitudinal central axis extending rearwardly from the forward head end, and (3) a bend between the rear head end and the forward head end, whereby the forward head longitudinal central axis and rear head longitudinal central axis are displaced from each other at the forward head end;

b. the bowstring notch is situated at least substantially coincident with the rear head longitudinal central axis.

10. The bowstring release of claim 9 wherein the body has a body longitudinal central axis which is:

a. at least substantially coincident with the rear head longitudinal central axis, and b. at least substantially parallel to the forward head longitudinal central axis.

11. The bowstring release of claim 8 wherein:

a. the jaw further has:

(1) an inner jaw surface bounding the bowstring notch, and (2) an opposing outer jaw surface, with the bowstring hook and latching surface being situated therebetween;

b. the latching surface includes:

(1) a curved outer latching surface section adjacent the outer jaw surface, and (2) an opposing inner latching surface section adjacent the inner jaw surface, with the jaw latch being situated therebetween;

c. the trigger member includes a curved forward trigger surface adjacent the trigger catch, wherein the forward trigger surface travels closely adjacent the outer latching surface section as the jaw rotates from the bowstring retaining position to the bowstring releasing position.

12. The bowstring release of claim 11 wherein the trigger pivot is situated between:

a. the forward trigger surface, and b. a rear trigger surface bearing a spring urging the trigger member toward the forward position, wherein:

(1) the spring is situated between the trigger member and a screw engaging the body, and (2) adjusting the screw into the body compresses the spring between the screw and the trigger member.

13. The bowstring release of claim 8 wherein the jaw includes:

a. an inner jaw surface bounding the bowstring notch, and an opposing outer jaw surface, with the bowstring hook being situated therebetween;

b. an approximately triangular jaw body opposite the bowstring hook, the jaw body being bounded by the inner jaw surface, the outer jaw surface, and the latching surface.

14. The bowstring release of claim 13 wherein:

a. the jaw latch is situated on the latching surface approximately midway between the inner jaw surface and the outer jaw surface, and b. the jaw pivot is located on the jaw body adjacent the hook and opposite the latching surface.

15. A bowstring release including:

a. a head extending between a forward head end and an opposing rear head end, wherein the head includes a bowstring release mechanism having:

(1) a trigger member bearing a trigger, wherein actuation of the trigger causes the bowstring release mechanism to release a bowstring;

(2) an adjustable member adjustably fit within the body, wherein the adjustable member's depth within the body can be adjustably reset, (3) a spring situated between the adjustable member and the trigger member, wherein adjusting the adjustable member into the body compresses the spring between the adjustable member and the trigger member, and b. an elongated body extending between a forward body end and a release mount, wherein the forward body end is pivotally affixed to the rear head end.

16. The bowstring release of claim 15 wherein a compressible washer is situated in compression between the rear head end and the forward body end.

17. A bowstring release including a head extending between a forward head end and an opposing rear head end, wherein the head includes:

a. a rear head longitudinal central axis extending forwardly from the rear head end, b. a forward head longitudinal central axis extending rearwardly from the forward head end, and c. a bend between the rear head end and the forward head end, whereby the forward head longitudinal central axis and rear head longitudinal central axis are displaced from each other at the forward head end;

d. a bowstring release mechanism having:

(1) a trigger member bearing a trigger, wherein actuation of the trigger causes the bowstring release mechanism to release a bowstring, (2) an adjustable member adjustably fit within the body, wherein the adjustable member's depth within the body can be adjustably reset, (3) a spring situated between the adjustable member and the trigger member, wherein adjusting the adjustable member into the body compresses the spring between the adjustable member and the trigger member, (1) a single jaw:

i. rotatably affixed to the forward head end at a jaw pivot, ii. having a bowstring hook with a hook length curving about a bowstring notch, wherein the bowstring notch is situated at least substantially coincident with the rear head longitudinal central axis; and iii. being actuated by the jaw to rotate between:

A. a bowstring retaining position wherein the hook curves rearwardly, and

B. a bowstring releasing position wherein the hook no longer curves rearwardly.

18. The bowstring release of claim 17 wherein the body has a body longitudinal central axis which is at least substantially coincident with the rear head longitudinal central axis.

19. The bowstring release of claim 18 wherein the forward head longitudinal central axis is at least substantially parallel to the body longitudinal central axis and the rear head longitudinal central axis.

20. The bowstring release of claim 17 wherein:

a. the jaw includes a latching surface opposite the bowstring hook, the latching surface having a jaw latch defined thereon;

b. the trigger member:

(1) is rotatably affixed to the head at a trigger pivot;

(2) has a trigger catch thereon, (3) is actuated by the jaw to rotate between:

i. a forward position wherein the trigger catch engages the jaw latch to fix the jaw into the bowstring retaining position, and ii. a pulled position wherein the trigger catch disengages the jaw latch to allow pivoting of the jaw into the bowstring releasing position.

21. The bowstring release of claim 17 wherein:

a. the jaw further has:

(1) an inner jaw surface bounding the bowstring notch, and
(2) an opposing outer jaw surface,
(3) a latching surface opposite the bowstring hook and between the inner and outer jaw surfaces, the latching surface including:
i. a curved outer latching surface section adjacent the outer jaw surface, and
ii. an opposing inner latching surface section adjacent the inner jaw surface,
iii. a jaw latch situated between the outer latching surface and the inner latching surface;

b. the trigger member:
(1) has a trigger catch thereon,
(2) is rotatable with respect to the head between:
i. a forward position wherein the trigger catch engages the jaw latch to fix the jaw into the bowstring retaining position, and
ii. a pulled position wherein the trigger catch disengages the jaw latch to allow pivoting of the jaw into the bowstring releasing position, and
(3) includes a curved forward trigger surface adjacent the trigger catch, wherein the forward trigger surface travels closely adjacent the outer latching surface section as the jaw rotates from the bowstring retaining position to the bowstring releasing position.

22. The bowstring release of claim 17 wherein:
a. the jaw includes:
(1) an inner jaw surface bounding the bowstring notch, and an opposing outer jaw surface, with the bowstring hook being situated therebetween;
(2) an approximately triangular jaw body opposite the bowstring hook, the jaw body being bounded by the inner jaw surface, the outer jaw surface, and a latching surface having a jaw latch defined thereon;

b. the trigger member:
(1) has a trigger catch thereon,
(2) is rotatable with respect to the head between:
i. a forward position wherein the trigger catch engages the jaw latch to fix the jaw into the bowstring retaining position, and
ii. a pulled position wherein the trigger catch disengages the jaw latch to allow pivoting of the jaw into the bowstring releasing position.

23. The bowstring release of claim 22 wherein the jaw pivot is located on the jaw body adjacent the hook and opposite the latching surface.

24. The bowstring release of claim 17 further including an elongated body extending between a forward body end and a release mount, wherein the forward body end is pivotally affixed to the rear head end.

25. A bowstring release including:
a. a head:
(1) extending between a forward head end and an opposing rear head end,
(2) including a bowstring release mechanism having:
i. a trigger member bearing a trigger, wherein actuation of the trigger causes the bowstring release mechanism to release a bowstring;
ii. a screw engaging the body,
iii. a spring situated between the screw and the trigger member,
wherein adjusting the screw into the body compresses the spring between the screw and the trigger member, b. an elongated body extending between a forward body end and a release mount, wherein the forward body end is pivotally affixed to the rear head end.

* * * * *